United States Patent [19]

Hart et al.

[11] 4,336,884

[45] Jun. 29, 1982

[54] EASY MOUNT PICTURE PACKAGE

[76] Inventors: LeRoy Hart, 273 Main St., Farmington, Conn. 06032; Mark L. Hart, 27-I Amato Dr., South Windsor, Conn. 06074

[21] Appl. No.: 103,864

[22] Filed: Dec. 14, 1979

[51] Int. Cl.[3] ..... B65D 69/00; B65D 71/00

[52] U.S. Cl. ..... 206/575; 206/806; 220/18

[58] Field of Search ..... 248/544, 467, 542, 489; 206/575, 216, 223, 806; 220/18

[56] References Cited

U.S. PATENT DOCUMENTS

| | | | |
|---|---|---|---|
| 3,180,528 | 4/1965 | Balint et al. | 206/806 |
| 3,900,059 | 8/1975 | Kirk et al. | 206/806 |
| 4,154,383 | 5/1979 | Honatzis | 206/806 |

FOREIGN PATENT DOCUMENTS

| | | | |
|---|---|---|---|
| 625051 | 9/1961 | Italy | 206/806 |

*Primary Examiner*—Joseph Man-Fu Moy

*Attorney, Agent, or Firm*—Prutzman, Kalb, Chilton & Alix

[57] ABSTRACT

A picture hanger locator package is provided comprising a long cardboard backing strip mounting one or more picture hangers at one end. Adhesive areas are provided on the front and back faces of the backing strip and the package assembly may include a protective covering. The hook portion of each hanger is mounted on the mounting portion of a picture frame and the front adhesive area may be pressed against the picture frame so that it is held in a proper position relative to the frame as the frame is positioned against the wall. The elongated backing sheet projects above the picture frame and, after proper positioning of the picture in its desired location, the back adhesive area is pressed into firm engagement with the wall so that the hanger is adhered to the wall at its proper location. The picture frame is then removed from the hook and the hanger is securely fastened to the wall in a conventional manner. The backing member is removed both from the wall and from the hanger leaving the hanger in its accurately positioned location for receiving and supporting the picture frame.

13 Claims, 11 Drawing Figures

FIG. 1
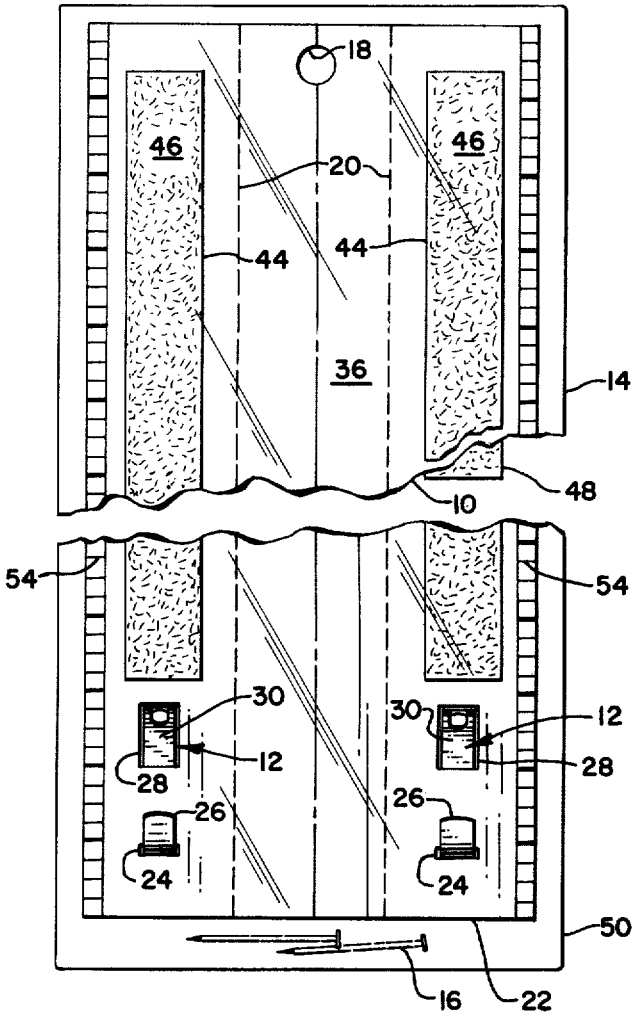
FIG. 2
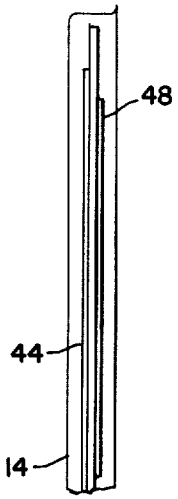
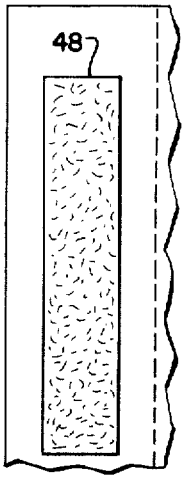
FIG. 3
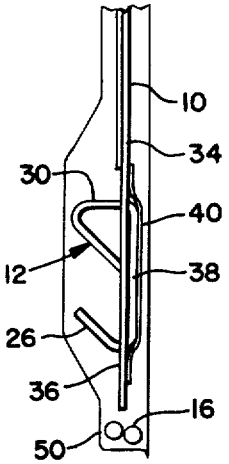
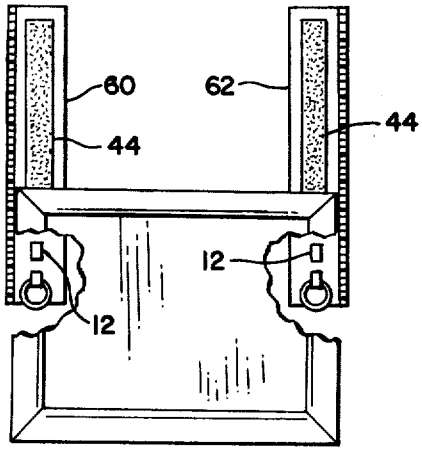
FIG. 5
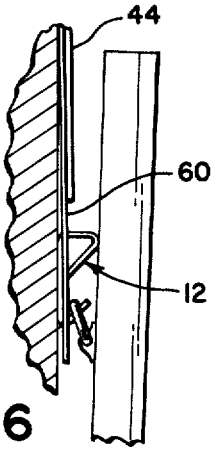
FIG. 6

EASY MOUNT PICTURE PACKAGE

The present invention relates generally to the hanging of picture frames and the like. More particularly it is concerned with a new and improved package assembly combining a picture hanger and an associated hanger locator and with a picture hanging method using the assembly.

Heretofor when mounting a picture frame or similar article on a wall surface it has been necessary to position the picture at the desired location and then attempt to properly locate the picture hanger so that when the picture is mounted thereon it will hang in the selected location. Frequently this requires the user to either judge the appropriate slack in the hanging wire on the back of the picture frame or reach behind the picture in an attempt to properly locate the picture hanger. Where two hangers are needed, it is even more difficult to properly locate and align the two hangers so as to position the picture frame at the desired location.

In accordance with the present invention it has been found that these difficulties can be avoided by using a relatively simple package assembly that combines the picture hanger with a hanger locating device that can be removably adhered to the wall once the picture frame has been properly positioned. The package assembly not only provides proper location for the hanger but also assures the proper relationship between multiple hangers used to mount a single item. The assembly has the advantage of permitting the accurate locating of the picture hanger without the necessity for groping behind the picture to determine the proper placement for the hanger. The locator also provides a means for properly supporting the hanger both within the package and after adherence to the wall until it is firmly secured to the wall surface or other support and the rapid and facile removal of the locator once the hanger has been secured.

These and other advantages will be achieved in accordance with the present invention by providing a package assembly comprising an elongated, generally rectangular, hanger-locating, backing sheet of cardboard-like material having a hanger-receiving aperture adjacent one longitudinal end thereof for receiving and orienting a hanger in alignment with the longitudinal dimension of the backing sheet. A first elongated adhesive area is provided on the front face of the backing sheet, the area having a first exposed adhesive surface for releasably adhering the backing sheet to a picture frame or the like. The first adhesive surface extends from a point adjacent the aperture longitudinally along the backing sheet to a point adjacent the end of the sheet opposite the apertured end. A second adhesive area is provided on the rear face of the backing sheet and has a second exposed adhesive surface for adhering the sheet to a picture frame support member or the like. The second adhesive surface extends from the end opposite the aperture in underlying relationship to the first adhesive area but for a substantially shorter longitudinal extent. A picture hanger having a forwardly extending hook portion is mounted on the backing sheet at the aperture with the hook portion projecting outwardly from the front face of the backing sheet. A removable protective covering overlies the first and second adhesive surfaces for keeping those surfaces free of contamination prior to use.

When using the package assembly of the present invention the protective covering is removed from the adhesive surfaces and the outwardly projecting hook portion of the hanger is mounted on the mounting portion of the picture frame or similar item being mounted. The first exposed adhesive surface may be pressed into adhesive engagement with the picture frame so that it is held in a proper position relative to the frame as the frame is positioned against the wall. The elongated backing sheet projects above the picture frame and, after proper positioning of the picture in its desired location, the second adhesive surface on the rear face of the backing member is pressed into firm engagement with the wall so that the hanger is adhered to the wall at its proper location. The picture frame can then be removed from the hook with the assurance that the hanger is properly located. The hanger is then securely fastened to the wall in a conventional manner and the backing member is removed both from the wall and from the hanger leaving the hanger in its accurately positioned location for receiving and supporting the picture frame.

The details of this invention will be further described in connection with the accompanying drawings in which;

FIG. 1 is a fragmentary elevational plane view, partially broken away, of the package assembly of the present invention;

FIG. 2 is a side view of the package assembly of FIG. 1;

FIG. 3 is a fragmentary view of a portion of the rear face of the assembly's backing sheet;

Figure 4A:
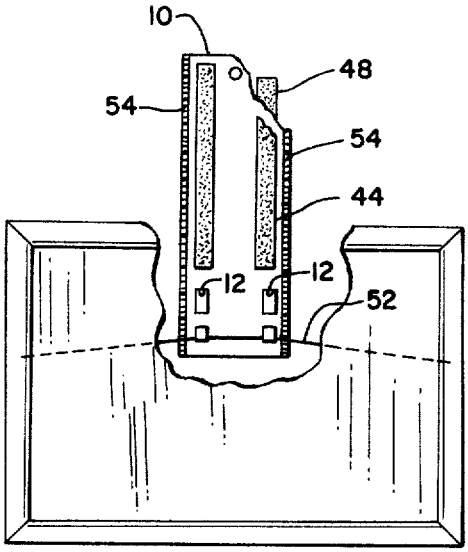
Figure 4B:
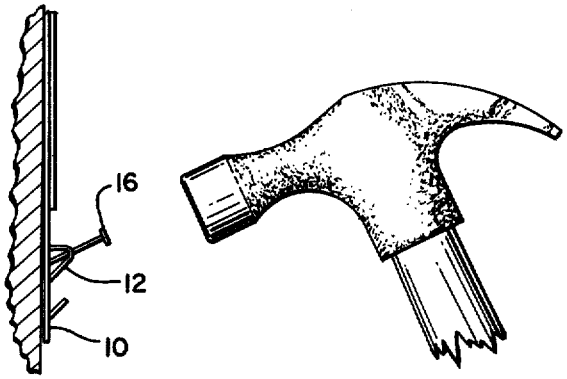
Figure 4C:
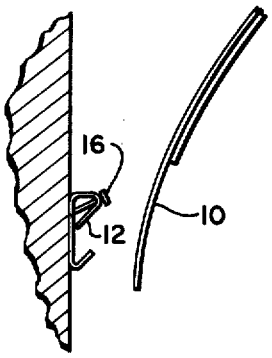
Figure 7:
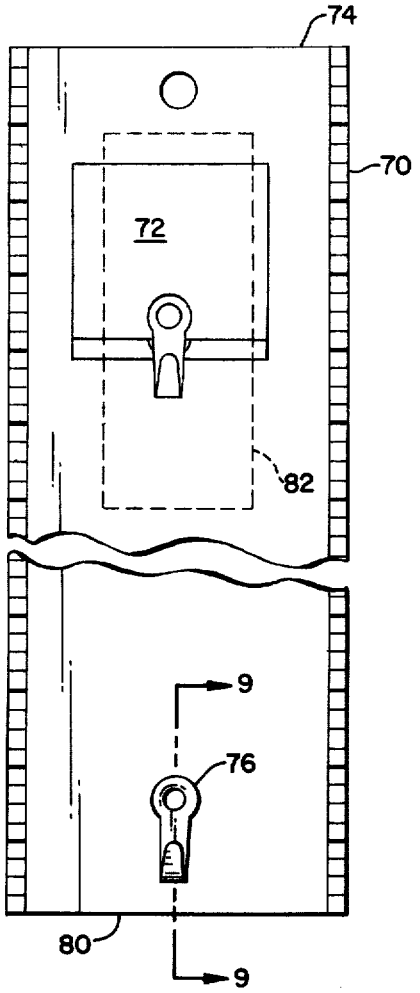
Figure 8:
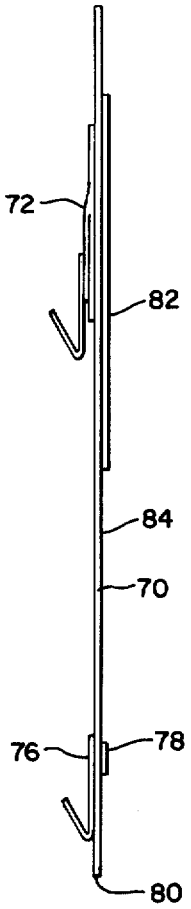

FIGS. 4*a*, 4*b* and 4*c* depict the manner of using the package assembly of FIG. 1 wherein FIG. 4*a* illustrates the picture hanger locator and hanger detachably mounted on the back of the picture frame and adhesively secured at a proper location to a wall or other supporting surface;

FIG. 4*b* illustrates the secure fastening of the hanger on the wall after the picture frame has been removed from the assembly; and FIG. 4*c* illustrates the simple operation of removing the backing sheet from the hanger after it has been secured to the wall surface;

FIG. 5 is an elevational view similar to FIG. 4*a* and depicts an alternative manner of using the assembly of FIG. 1;

FIG. 6 is an enlarged fragmentary side view of the hanger area of the assembly of FIG. 5;

FIG. 7 is a fragmentary elevational view of an assembly similar to FIG. 1 showing an alternative embodiment thereof;

FIG. 8 is a side view of the assembly of FIG. 7; and

Figure 9:
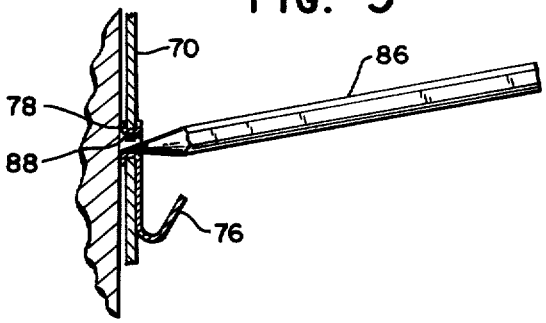

FIG. 9 illustrates an additional step in the method when using the embodiment of FIGS. 7 and 8.

Referring now to the drawings in greater detail wherein like reference numberals indicate like parts throughout the several figures, one preferred embodiment of the package assembly of the present invention is shown in FIGS. 1–5 as being comprised of a backing sheet 10 of cardboard or the like having one or more picture hangers 12 mounted thereon and with the entire backing/hanger assembly protectively enclosed within a sealed plastic bag or wrapping 14. The package assembly illustrated in FIG. 1 also contains suitable fasteners such as nails 16 for securing the hangers 12 to a wall surface or the like and is provided with a circular aperture 18 for mounting the assembly on a display rack or the like.

The backing member 10 is an elongated, generally rectangular sheet that may be divided longitudinally into two or more strips along longitudinally extending perforation lines 20, such as those shown in FIG. 1, so that the backing member and hanger mounted thereon can be used in a variety of different ways. Referring specifically to FIGS. 1 and 2, the backing sheet 10 is preferably of a size that will extend above a picture frame and will permit mounting of a pair of picture frame hangers 12 with a relative spacing sufficient to provide the stabilized hanging of the frame. In this connection, it has been found that a preferred backing sheet size exhibits a breadth or width of about 3 inches per pair of hangers and a length sufficient to permit ease of viewing and of using the portion that extends above the top edge of the picture frame. In this connection the backing sheet material 10 typically has a length of about one foot. Adjacent the bottom longitudinal end 22 of the sheet material there is provided two sets of transversely spaced apertures for mountably receiving the projection portion of each picture hanger 12. In the specific embodiment illustrated, each set of apertures consists of a first narrow slot 24 adjacent and parallel to the bottom edge 22 of the backing sheet for receiving the hook portion 26 of the hanger 12 and a second generally rectangular aperture 28 longitudinally spaced from the narrow slot for receiving the upper support portion 30 of the hanger 12.

As best seen in FIG. 2 the hanger is mounted on the backing sheet from the rear face 34 thereof so that the hook 26 and triangular upper support portion 30 of the hanger pass through their respective apertures 24, 28 and project forwardly beyond the front face 36 of the backing sheet 10 while the main body portion 38 of the hanger rests against the rear surface 34. The hanger is held in place in that position by a suitable thin covering 40 such as a blister pack type of plastic sheet material. As is readily apparent, the supported hanger thus is oriented so as to be parallel to the longitudinal extent of the backing sheet and is located adjacent one end thereof so that when in use the remainder of the backing material will project upwardly and extend well above the top edge of the picture frame to more easily facilitate its locating function.

A first elongated adhesive area 44 is provided on the front face 36 of the backing sheet material in longitudinal alignment with the hanger-mounting apertures 24, 28 and extends continuously from a point adjacent the apertures toward the opposite longitudinal end of the backing sheet material. The front elongated adhesive area 44 is provided with an exposed adhesive surface 46 that can be easily secured to the top edge of a picture frame by simply applying pressure therebetween, yet is of a type that also can be easily stripped or pulled away from the picture frame. The adhesive area is a continuous member permitting its ready engagement with the top edge of the picture frame regardless of the size thereof. Thus, typically the adhesive area will have a length of about 9 to 10 inches and a typical width of approximately $\frac{1}{2}$ to $\frac{3}{4}$ inch. As will be appreciated the exact size of the adhesive area may vary depending on the configuration of the backing sheet material and the number of hangers mounted thereon. For example, the area could extend across the full width of the front face of the backing sheet or could be in the form of a patterned adhesive surface so long as it provides the necessary function of releasably engaging different size picture frames during the locating and mounting operations.

A second adhesive area 48 is provided on the rear face 34 of the backing sheet material in underlying relationship with the first or front adhesive area 44. The second adhesive area provides the function of securing the cardboard backing material to the wall surface or other supporting structure and therefore, as shown in FIG. 3, need not extend longitudinally along the backing material for as great a distance as the first area 44 located on the front face of the backing material. For example the second adhesive area 48 may be only one third the length of the first adhesive area 44 and preferably is located adjacent the top end of the backing sheet so that it will project above the picture frame and can be readily pressed against the wall surface for adhering the sheet to the wall or other support after the picture frame has been properly positioned in its desired location. The second adhesive area 48 may have a width identical to the first adhesive area 44 and be in underlying registry therewith, as shown, or may extend beyond the edges of the top adhesive strip so as to provide firm and secure engagement with the supporting wall surface.

As will be appreciated, both front and rear exposed pressure sensitive adhesive surfaces must be protected from contamination prior to use in order to assure their proper functioning during the picture hanging operation. Accordingly, individual cover strips or release layers can be used to protectively cover the adhesive surfaces or, as illustrated in FIGS. 1 and 2, a sealed plastic bag or covering 50 may enclose the entire backing sheet and hanger. Such a structure also serves as a convenient container for associated materials such as the fastening nails 16 or other items which the manufacturer might wish to include in the package assembly. In this connection the plastic bag also may be heat-sealed to the backing material along the center portion between the two hangers or simply about the outer edges thereof.

Referring now to FIGS. 4*a*–4*c* there is depicted some of the major steps followed in utilizing the package assembly of FIGS. 1 and 2. As will be appreciated the protective covering such as the sealed plastic bag 50 of the package assembly is entirely removed in preparation for locating and mounting the hanger on the support surface. As shown in FIG. 4*a* the hangers 12 mounted on the backing member 10 are hooked onto the mounting wire 52 extending across the back of the picture frame and the backing member 10 is properly positioned relative to the frame to assure that the frame will hang in a straight and true manner in its selected location. In this connection it is quite easy to align the top edge of the frame with the color code lines 54 provided on the longitudinal edges of the backing member 10. This will tend to assure a straight, square and true mounting of the picture frame even if the wire on the back of the frame has not been accurately positioned on each side of the frame.

When using a backing member that has not been separated along a perforation line 20 it is not absolutely necessary that the adhesive surface 46 on the front face 36 of the backing member be adhered to the picture frame. However, if desired or if the frame is inordinately large so as to require the use of both hands to position the frame, then the backing strip may be adhesively secured to the picture frame using the first adhesive surfaces 46 located on the front face of the backing member. If this is to be done it is important that the backing member 10 be raised to its highest position so as to slightly tension the wire 52 on the back of the frame. This will prevent the picture from sagging when it is permanently mounted. However, as mentioned, if the picture is easily handled with one hand, the other hand can be used to hold the backing member 10 at its highest position during the positioning of the picture frame without the necessity for adhering the backing member to the frame.

The picture with the hangers hooked thereon and with the backing member extending above the top edge of the frame, is located against the wall surface in its desired position and the backing member is then pressed against the wall so as to provide adhesive engagement between the rear adhesive area 48 on the backing member and the wall surface. The picture frame is released from the backing member at the time of adhering the backing sheet 10 to the wall. Thereafter the picture is removed from the hangers while assuring that the backing member remains adhered to the wall. Thus the picture is lifted up and off of the hangers leaving the backing member secured to the wall surface by the adhesive area 48 on the back face thereof. As a result of this operation the hangers 12 carried by the backing member 10 are properly located against the wall surface and, as illustrated in FIG. 4*b*, can be easily secured to the wall surface by means of an appropriate fastener such as the nails 16 originally packaged within the plastic covering of the package assembly. With the hangers 12 properly and firmly secured to the wall surface at their correct location the backing member 10 has completed its locating function and can easily be removed by simply stripping the backing member from the hanger as illustrated in FIG. 4*c*. The picture frame can then be hung on the properly located hangers with the assurance that it will be positioned in the selected and desired position.

In those instances where the user desires to provide a greater separation between the two hangers or where the picture frame is provided with swivel loops rather than a mounting wire across the back of the frame, the above described procedure can be altered to accommodate this variation. For example as illustrated in FIGS. 5–6 the backing member 10 may be separated along its lines of perforation 20 to provide a pair of backing strips 60, 62 each mounting a separate hanger 12. In this instance, substantially the same mounting procedure is followed except that it is usually necessary to assure that the adhesive area 44 on the front face of each backing strip is secured to the picture frame before attempting to place the picture against the wall and determine its proper and desired position. The adhesive area 44 on the front face of the backing strip will obviate the need for holding the strips and permit the user to simply hold the picture frame and properly position it on the wall surface. After the positioning has been achieved, each backing strips need simply be pressed against the wall individually to assure proper adhesion between the backing strip and wall. Then the procedure outlined hereinbefore with respect to FIG. 4 is followed, namely, the removal of the picture from the hooks followed by the secure fastening of the hangers to the wall surface and the removal of the backing strips from the hangers.

As will be evident to many users it is frequently undesirable to secure the hanger to the wall by means of a fastener such as a nail. In those instances adhesive cloth backed hangers have been employed and the package assembly and method of the present invention is readily adapted to such adhesive cloth backed structures. In this connection such an adaptation or alternative embodiment is depicted in FIGS. 7 and 8. As illustrated therein the cardboard member 70 used as the hanger locator is substantially the same as the backing member 10 illustrated in FIGS. 1–5. However, in the particular embodiment illustrated, an adhesive cloth backed hanger 72 used to mount the picture permanently on the wall is attached to the backing member adjacent the top end 74 thereof and a locator hook 76 is securely positioned by means of a retaining eyelet 78 or the like adjacent the bottom edge 80 of the generally rectangular backing member 70. An adhesive area 82 on the rear face 84 of the backing member 70 is similar in configuration and function to the adhesive area 48 on the rear face of the supporting member 10 in FIGS. 1–5. In the specific embodiment illustrated no adhesive area is shown on the front face of the backing member although such an adhesive area could be employed if desired.

When using the structure of FIGS. 7 and 8, the picture frame is mounted on the locator hook 76 and the backing member 70 is secured to the wall by means of the adhesive area 82 on its rear face 84 after proper positioning of the picture. However upon removal of the picture frame the proper location of the hanger is marked, as illustrated in FIG. 9, by means of a pencil 86 or other marking device, preferably through the aperture 88 in the eyelet 78 securing the locator hook 76 to the backing member 70. After marking the wall surface the entire assembly is removed from the wall and the adhesive cloth backed hanger 72 supported by the backing member 70 can then be removed from the backing member and placed in its marked location in accordance with its usual manner of attachment to the wall surface.

In view of the fact that the cloth backed hanger need not be used for locating the proper hanger position, it will be appreciated that the adhesive backed hanger need not be secured to the locator strip or backing member but can be simply contained within the same packaging unit for use in accordance with the method described hereinabove. Alternatively, the cloth backed hanger could be mounted at and used in place of the locator hook 76 to mark the wall while the locator strip is adhered in its proper position. In that event the backing member could be stripped or removed from the cloth backed hanger either before or after proper adhesion of the hanger to the wall surface. However, this latter technique is less desirable and the structure shown in FIGS. 7 and 8 is preferred since the adhesive backing for the hanger typically requires moistening in order to provide firm and secure attachment of the cloth hanger to the wall surface.

We claim:

1. A package assembly combining a picture hanger locator and a picture hanger comprising an elongated generally rectangular hanger-locating backing sheet of cardboard-like material having hanger-receiving means adjacent one longitudinal end thereof for receiving and orienting a hanger in longitudinal alignment with the longitudinal dimension of the backing sheet, first elongated adhesive means on the backing sheet having a first exposed adhesive surface for removably securing the front face of the backing sheet to a picture frame, said first adhesive surface extending from a point adjacent said hanger-receiving means longitudinally along said backing sheet to a point adjacent the end of said sheet opposite said one end, second adhesive means having a second exposed adhesive surface for removably securing said opposite end of the backing sheet to a picture frame support, a picture hanger mounted on said backing sheet by said hanger-receiving means and having a forwardly extending hook portion projecting outwardly from the front face of said sheet, said sheet having a length sufficient to extend well beyond the top edge of a picture attached to said hook when said hanger is mounted on said sheet and a removable protective covering overlying said first and second adhesive surfaces for keeping said surfaces free of contamination prior to use.

2. The package assembly of claim 1 wherein said backing sheet mounts a plurality of transversely spaced hangers.

3. The package assembly of claim 2 wherein said backing sheet is provided with longitudinally extending perforation lines for dividing said sheet into strips having hangers mounted thereon.

4. The package assembly of claim 1 wherein said first adhesive means is an adhesive area on the front face of the backing sheet.

5. The package assembly of claim 4 wherein said adhesive area extends continuously between said hanger-receiving means and said opposite end.

6. The package assembly of claim 1 wherein said second adhesive means is an adhesive area on the rear face of the backing sheet with said second adhesive surface being in underlying relationship with said first adhesive means and extending for a substantially shorter longitudinal extent than said first elongated adhesive means.

7. The package assembly of claim 1 wherein said hanger-receiving means includes an aperture and said hanger extends through said aperture and is releasably supported on said backing sheet.

8. The package assembly of claim 1 wherein said protective covering encloses both said backing sheet and said hanger.

9. The package assembly of claim 1 wherein said backing sheet is provided with means for assuring square and true mounting of the picture on said hanger.

10. A package assembly combining a picture hanger locator and a picture hanger comprising an elongated generally rectangular hanger-locating backing sheet having hanger-receiving means adjacent one longitudinal end thereof for receiving and orienting a hanger in longitudinal alignment with the longitudinal dimension of the backing sheet, first adhesive means having a first exposed adhesive surface for removably securing the front face of the backing sheet to a picture frame, second adhesive means having a second exposed adhesive surface for removably securing said opposite end of the backing sheet to a picture frame support, a picture hanger mounted on said backing sheet by said hanger-receiving means and having a forwardly extending hook portion projecting outwardly from the front face of said sheet, said sheet having a length sufficient to extend well beyond the top edge of a picture attached to said hook when said hanger is mounted on said sheet and removable protective covering means overlying said first and second adhesive surfaces for keeping said surfaces free of contamination prior to use.

11. The package assembly of claim 10 wherein said first adhesive means is adapted to releasably engage different size picture frames during use.

12. A package assembly combining a hanger and hanger locator comprising an elongated generally rectangular hanger-locating backing sheet of cardboard and the like having a locator hook secured thereto adjacent one longitudinal end thereof, a picture hanger associated with the backing sheet for mounting a picture thereon, an adhesive area on the back face of the backing sheet having an exposed adhesive surface for engaging a picture frame support surface, said adhesive surface being adjacent the end of said sheet opposite said one end for adhesively engaging said picture support surface, said hook including means facilitating the accurate marking of its location on said support surface.

13. The package assembly of claim 12 wherein said picture hanger is of the adhesive backed hanger type.

* * * * *